United States Patent [19]

Gratz et al.

[11] Patent Number: 4,705,290

[45] Date of Patent: Nov. 10, 1987

[54] RUNNING SURFACE CONSTRUCTION FOR SKIS

[76] Inventors: Matthias Gratz, Brotteroder Str. 19, DDR-6086Pappenheim; Schmalz Hans-Dieter, Hauptstrasse 53, DDR-6081 Mittelschmalkalden; Gerald Stadler, Gothaer Str. 91, DDR-6087 Seligenthal; Lothar Hildenbrandt, Mühebach 2, DDR-6086 Pappenheim, all of German Democratic Rep.

[21] Appl. No.: 22,477

[22] Filed: Mar. 6, 1987

Related U.S. Application Data

[63] Continuation of Ser. No. 750,631, Jul. 1, 1985, abandoned.

[30] Foreign Application Priority Data

Jul. 24, 1984 [DD] German Democratic Rep. ..... 2655698

[51] Int. Cl.[4] ..... A63C 5/044

[52] U.S. Cl. ..... 280/604

[58] Field of Search ..... 280/604, 605, 609, 610

[56] References Cited

U.S. PATENT DOCUMENTS

| | | | |
|---|---|---|---|
| 3,858,894 | 1/1975 | Ver et al. | 280/604 |
| 4,223,909 | 9/1980 | Danner et al. | 280/604 |
| 4,262,925 | 4/1981 | Plenk | 280/604 |
| 4,323,265 | 4/1982 | Benner | 280/604 |
| 4,359,077 | 11/1982 | Staufer . | |
| 4,440,418 | 3/1984 | Staufer | 280/604 |

FOREIGN PATENT DOCUMENTS

| | | |
|---|---|---|
| 364726 | 11/1981 | Austria . |
| 1954075 | 5/1971 | Fed. Rep. of Germany . |
| 2627887 | 12/1977 | Fed. Rep. of Germany . |
| 2755395 | 6/1979 | Fed. Rep. of Germany . |
| 8004825 | 2/1980 | Fed. Rep. of Germany . |
| 2265524 | 9/1980 | Fed. Rep. of Germany . |
| 7305166 | 9/1974 | France . |
| 162175 | 8/1933 | Switzerland . |

*Primary Examiner*—John J. Love
*Assistant Examiner*—Eric D. Culbreth
*Attorney, Agent, or Firm*—Gabriel P. Katona

[57] ABSTRACT

Running sole structuring for a ski, especially for a cross-country ski.

The object of the invention is to provide a new profiling which combines optimum gliding and climbing characteristics. Therefore, it is the object of the invention, to provide a suitable shaping of the profiling which fully considers the special requirements under different snow conditions as well as the special loadings of the ski during the push-off and gliding phases, as well as the process of sticking and gliding friction and the transitional phases associated therewith directly.

This object is solved according to the invention by the provision of exclusively straight, vertical and parallel arranged profile edges with respect to the direction of the run which are also two-dimensional in the plane of contact with the snow and are statistically arranged and, wherein the adjacent pairs of climbing edge rows lying behind each other lie on a gliding arc. It is preferred when the mean edge length ($\bar{b}_n$) in the push-off region (A) is the smallest and increases continuously and/or discontinuously toward one ski tip, respectively ski end, and wherein in the end region of the longitudinal extent of the profiling the maximum value for the mean edge length ($\bar{b}_n$) is attained. (FIG. 2 with FIG. 3 together).

14 Claims, 9 Drawing Figures

RUNNING SURFACE CONSTRUCTION FOR SKIS

This is a continuing application of application Ser. No. 750,631, filed on July 1, 1985 now abandoned.

FIELD AND BACKGROUND OF THE INVENTION

The invention relates to the formation of the running surface of skis, especially cross-country skis with or without a guide groove running in the longitudinal direction of the ski and a profiling arranged in the middle longitudinal region of the ski.

Running surface profiling for the improvement of the climbing effect of skis has long since been known. The various basic forms of the profiling are related to each other in one or more of their systematic arrangements. With the various profile forms one attempts to find a compromise between good climbing and good gliding characteristics. AT-PS 364,726 describes accordingly an embodiment which is characterized by flat rectangular surfaces arranged obliquely with respect to the snow upper surface in lateral or longitudinal directions of the ski with a constant spacing. For the sake of good climbing characteristics, in this embodiment due to the shaping and arrangement of the gliding surface, one will sacrifice good gliding characteristic.

Another possibility, which attempts to increase the climbing effect by a special structuring of the profiling, is described in EP 001557 and DE GM 8004825.

Both of these patent applications describe embodiments in which the height of the profiling is larger in the step-in region when compared with the remaining regions.

Regarding such embodiments one may say that the climbing characteristics are not influenced essentially by the magnitude of the grade, however, they are defined substantially by the force influence exerted onto the snow upper surface, at which upper surface of the snow becomes sheared off. The snow resistance to shearing off is dependent on the present snow type.

DE-OS 2755395 makes an attempt, on the other hand, to attain a good gliding characteristic by a special structuring of the gliding surface of the "scales". The arched basic shape of the scales will lead to the formation of force components which are oblique to the running direction when in the climbing phase of skiing. The force components cause an untimely shearing off of the upper surface of the snow and, thereby, the climbing effect of the profile becomes substantially reduced.

In contrast to the so far described embodiments of climbing aids DE-OS 2627887 and DE-OS 2852513 describe a different approach. These applications describe an arrangement of climbing aids arranged only on the inner side of the ski. The outer sides are in both laid-open applications formed for good gliding. With these so arranged climbing aids a good climbing effect can be attained, however, with such a running surface structuring an appropriate running style is necessary. The climbing effect of such structured climbing zone will not increase without wax being applied onto the smooth cover in the middle region in order that good climbing characteristics could be obtained.

Other embodiments, such as known from AT-PS 182997, as well as from DE-AS 2265524, attempt to substantially increase the gliding speed by non-uniform distribution of the profiling on the running surface of the ski.

In AT-PS 182997 such profiling is in the form of parallel grooves running along the longitudinal edges of the ski. Such an embodiment is characterized by a squeaking noise occurring during the gliding, which in turn will lead to an increased loss of gliding ability due to friction.

In DE-AS 2265524 the object is to suppress such "squeaking" stemming from the above arrangement.

Such object is proposed to be solved by a non-harmonic, special group-arrangement of rows, wherein the rows are systematically offset with respect to each other.

Also in such an embodiment the traveling noises cannot be completely eliminated with the help of the group-formation.

It is an object of the invention to provide a new running surface profiling which combines an optimum gliding and climbing characteristic.

The technical drawbacks of the known running surface profiling arrangements are caused in that the previously developed profile forms insufficiently consider the special requirements of the different snow types, the special loadings of the ski in the push-off and gliding phase, as well as the details of the process during the sticking and gliding of the profiling with respect to the snow, as well as the same during the transition phase sticking/gliding/sticking.

SUMMARY OF THE INVENTION

It is, therefore, the object of the invention to provide an appropriate structuring of the profiling which fully considers the requirements of the different snow types, the special loading of the ski during the push-off and gliding phase, as well as the process of sticking and gliding frictions immediately associated therewith and, also the same during the transition phase.

Such object is solved according to the invention in that the employed profiling comprises exclusively of edges which are arranged vertically and parallel with respect to the running direction.

As a result of research and experimenting it can be proved, that climbing edges (K1, K2) which are arranged vertically with respect to the running direction will attain the best climbing characteristics. On the other hand, the edges (K3) which run parallel with respect to the running direction, will assure the side guiding of the ski.

The invention provides that the such formed climbing profile in the plane of the surface of the ski contacting the snow is arranged in a two-dimensional form statistically. On the basis of such two-dimensional statistical arrangement the periodically occurring sinking of the running sole profile into the climbing profile which has been impressed into the snow and, the subsequently following lifting up of the ski is avoided whereby the sliding resistence is substantially reduced when compared with the hereto known profile formations. In addition, it is characterized in that the paths of the climbing edge rows (K1, K2) directly following behind each other are arranged on a glide arch (FIG. 3). As a result, in one aspect, in the gliding phase a large upper surface of the individual climbing aid elements will come into contact with the upper surface of the snow and thereby the gliding resistance will be kept at a minimum, while the ski will sink into the upper surface of the snow only slightly. The fact that hard snow possesses a higher force absorbing capacity than a softer snow, has been fully considered, wherein the expression "force absorbing capacity" should mean that the force parallel to the upper surface of the snow, which is required in order to shear-off the upper layer of the snow. With the help of the embodiment according to the invention, wherein the edge height H2 of the edges K2 is somewhat smaller than the edge height H1 of the edge K1 (see FIG. 3), it is assured that in the event of hard snow only the edges K1 and, on hand of soft snow, the edges K1 as well as the edges K2 will go into engagement. Therefore, in the case of soft snow the reduced force absorbing characteristic will be compensated by means of the additionally effective edges K2.

Furthermore, it is essential, that the middle edge length $\bar{b}_n$ in the push-off region A is kept the smallest and should increase in the direction of the ski tip and/or ski end, continuously and/or discontinuously, and wherein in the end regions of the longitudinal extent of the profiling the maximum value $\bar{b}_n$ is attained.

Such diminution of $\bar{b}_n$ in the push-off region (FIG. 1), in as much as the specific pressure on a climbing aid element is thereby substantially increased and will lead to a resultant increase in the climbing effect on hard snow and, crusted snow, however, it is always assured that the push-off region will lift itself off due to the ski tension and, there will always be assured an optimum gliding on the longitudinal edges $\bar{b}_n$ in the zones outside the push-off region.

It is also characteristic that the middle edge length $\bar{b}_n$ is the smallest on the inner edge of the ski and increases continuously and/or discontinuously in the direction of the outer edge of the ski, wherein such change of $\bar{b}_n$ over the entire region of the longitudinal extent of the profiling or even over partial regions thereof can be provided continuously and/or discontinuously, whereby the fact has been given consideration, that during the push-off and climbing, the inner region of the ski becomes more loaded than the outer region, and wherein due to such measures the specific pressure falling on a climbing aid element will be substantially increased on the inner edge of the ski and, thereby, the above-described effects can be attained. The combined effect of all inventive features is brought about by an optimum shaped running surface profiling.

BRIEF DESCRIPTION OF THE DRAWINGS

In the following description the invention will be explained in more detail using an embodiment in conjunction with five drawings which illustrate in.

DESCRIPTION OF THE PREFERRED EMBODIMENTS

Figure 1:
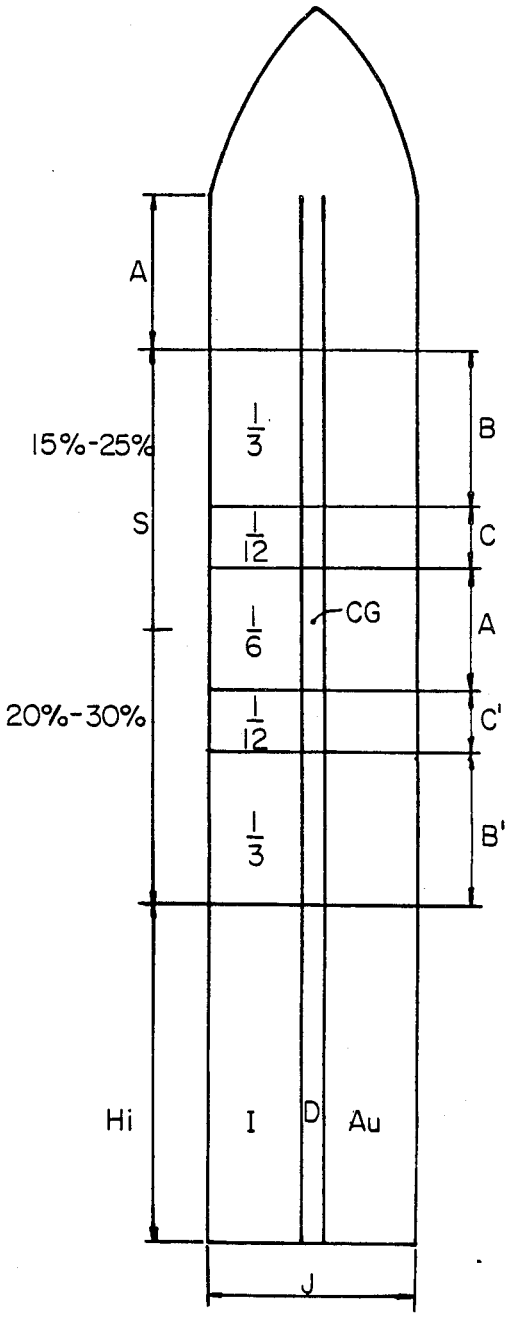
FIG. 1: a ski with functional zones
Figure 2:
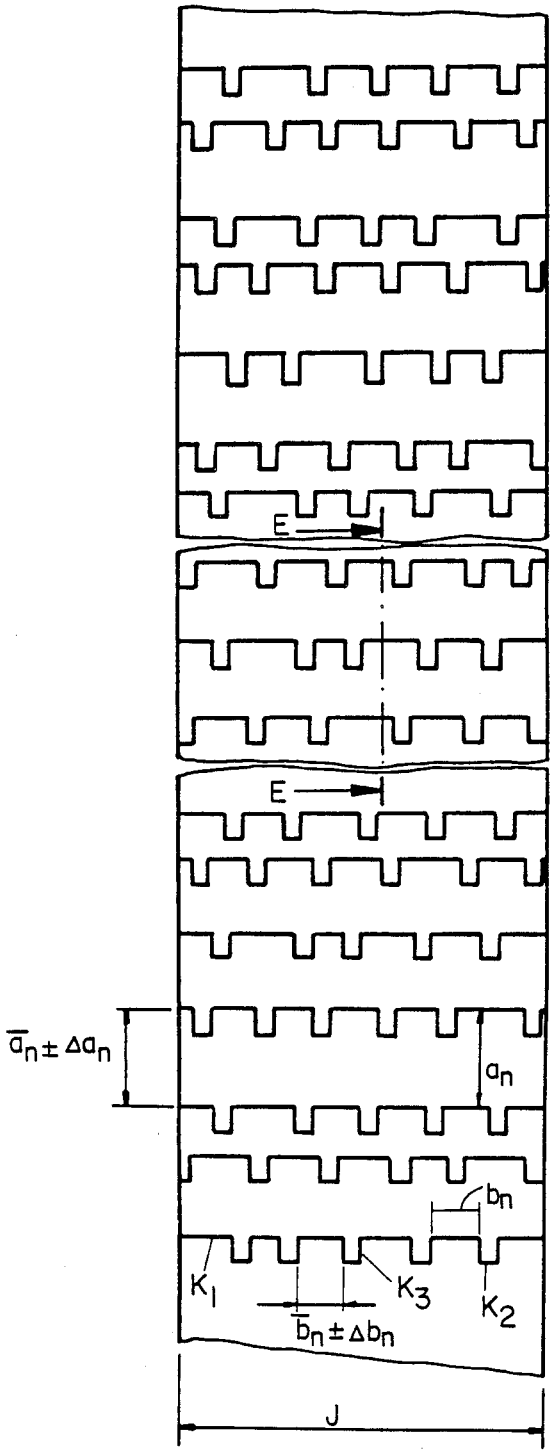
FIG. 2: a sketch of the newly developed profiling
Figure 3:
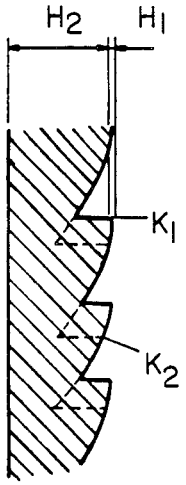
FIG. 3: a cross-section with side view of the profiling

As illustrated in FIGS. 1–3, in the middle region of the running surface S a step-shaped profiling is provided, to which in the direction of the ski tip and ski end a smooth running sole layer A and Hi is joined. As a material, PE (polyethylene) is preferred. The percentages appearing in FIG. 1 relate to the length of the respective zones, such as the climbing zone on the running surface of the ski, with respect to the entire ski length. More particularly, the percentage values 15–20% relate to the magnitude of that particular region with respect to the entire ski length and starting from the center of gravity CG of the ski as indicated in FIG. 1. The region 15–25% is counted in the direction of the tip of the ski, while the region 20–30% is counted toward the end of the ski. Therefore, the region S indicated in FIG. 1, represents the running surface profiling expressed in percent value with respect to the entire ski length from tip to the back edge, which itself represents the 100% value.

The step-shaped profiling comprises an arch-like upper surface (gliding arch) rising backward up to the edge K1 and, which according to FIG. 3, is curved in such a manner, that a large upper surface of the individual profiling elements will come into contact with the upper surface of the snow and, thereby in the gliding phase of the ski the gliding resistance will be kept slight, while the ski will sink into the upper surface of the snow only to a small extent.

A systematic analysis of all possible profile shapes has proved, that the formation of transverse climbing edges K1, K2 with K1 in spaced parallel relationship to K2 with respect to the running direction will lead to best climbing characteristics. The climbing characteristics of the ski is determined by the total length of the edges which sink into the upper surface of the snow. The edges K3 which are parallel with respect to the running direction will assure a side guiding during the climbing phase.

The shape and variation of the straight edges K1 and K2 vertically and parallel with respect to the running direction according to the invention will assure that no force components are produced obliquely during push-off with respect to the running direction. As a result, it is assured, that the force absorbing properties in the push-off direction become used to a maximum extent.

It has been noted, that hard snow possesses a much higher "force absorbing capacity" than the soft snow. Herein the phrase force absorbing capacity should be understood as a force which is parallel with respect to the upper surface of the snow and which is required in order to shear off the upper layer of the snow. If during push-off the force exerted by the runner through the profile region is greater than the force absorbing capacity of the snow, then the upper snow layer becomes sheared off and the ski will roll back during the push-off.

In the individual profiling rows which are vertical with respect to the running direction and the straight edges K1, K2 are always arranged with different edge heights.

The edges K2 are slightly offset in the direction of the ski end with respect to the edges K1. As a result, the curving of the upper surface of the individual profile elements into a gliding arch, will result in that the edge height H2 of the edges K2 is slightly smaller than the edge height H1 of the edges K2 (see FIG. 3).

As a result, it will be assured that during a slight sinking of the profile into the hard upper surface of the snow will bring about only an influence of the edges K1.

In the case of soft snow the profile will sink much deeper into the snow and the edges K1 and K2 can be jointly effective.

As a result, in soft snow, the reduced force absorbing capacity will be compensated by the additionally effective edges K2. This results in the assurance that in the case of different snow types (hard and soft snow) a constant climbing characteristics for the ski can be obtained. Experiments have proven that the running sole profiling with a constant profile spacing vertical and parallel with respect to the running direction results in a relatively high gliding resistance during gliding. The cause for the increased gliding resistance in the glide phase of the ski can be explained by that the ski during the forward gliding will sink into its own profiling pattern which has been already impressed into the snow. Simultaneously during the gliding a periodically recurring lifting of the ski will occur from such pattern which has been impressed into the snow. The energy which is necessary for this will be derived from the kinetic energy of the skier whereby his run will be slowed down.

This effect may be avoided, according to an embodiment (FIG. 2), by a pure statistical distribution of the spacing of the climbing aid elements which are parallel and vertical with respect to the running direction (two-dimensional).

Such statistical distribution can be brought about in the following manner: With a given constant mean spacing of the profiling rows is $a_n$ and with a maximum variation width $\Delta a_n^{max}$, the individual spacing of the profiling rows can statistically vary with $\pm\Delta a_n$ within the maximum variation width $\Delta \bar{a}_n^{max}$. As a result, the total spacing from row to row will always have a magnitude of $a_n \pm \Delta \bar{a}_n$.

Similarly as described, the statistical distribution of the edge length $\bar{b}_n$ can, similarly be realized. The individual spacing of the profiling elements which are vertical with respect to the running direction has, therefore, a value, respectively, magnitude of $\bar{b}_n \pm \Delta \bar{b}_n$, according to FIG. 2.

Figure 4:
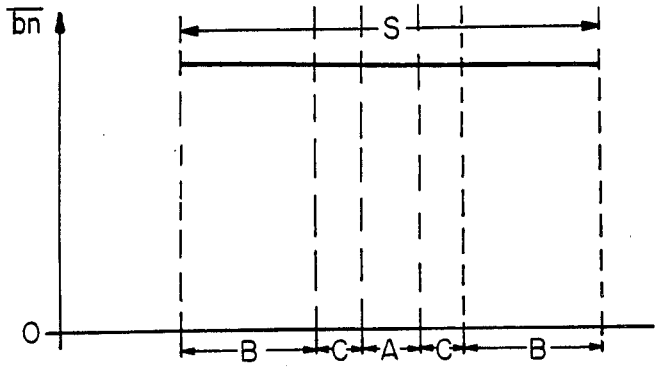
FIGS. 4–7: variants of the statistical distribution over the profiling length $\bar{a}_n$ and $\bar{b}_n$.

A viewing in total, in this last mentioned embodiment the mean spacing $b_n$ will be retained over the entire profiling region S (see FIG. 4), wherein a statistical distribution of the individual spacings $b_n$ in this embodiment has been proven on the basis of the individual spacing $b_n$ over the ski width J. Due to the pure statistical distribution of the individual profiling elements on the running sole, the gliding resistance will become substantially reduced inasmuch as due to the above-mentioned distribution, the pattern which has been impressed during the gliding phase will not become overlapped by a pattern of the profiling region of the ski. As a result, a sinking of the ski into its own pattern and the resulting increased energy output during the gliding movement becomes eliminated. A noticeably reduced gliding resistence and the associated increase of the gliding speed of the ski in all snow types, which is preferable for skiing, will be the result of such arrangement of the profiling elements.

Such object becomes accomplished in the simplest fashion by a statistical arrangement of the profiling elements in the region S, at which the mean value $\bar{b}_n$ is constant and will thereby correspond to the simplest practical example.

A third advantage of the shaping of the profiling zone according to the invention resides in that the traveling noises and the whistling sound are suppressed, which in the profiling having periodically following spacings will appear negatively.

For an appropriate changing of the climbing characteristics the edge lengths $b_n$ can be varied independently from the length of profiling region (FIG. 1.)

Figure 5:
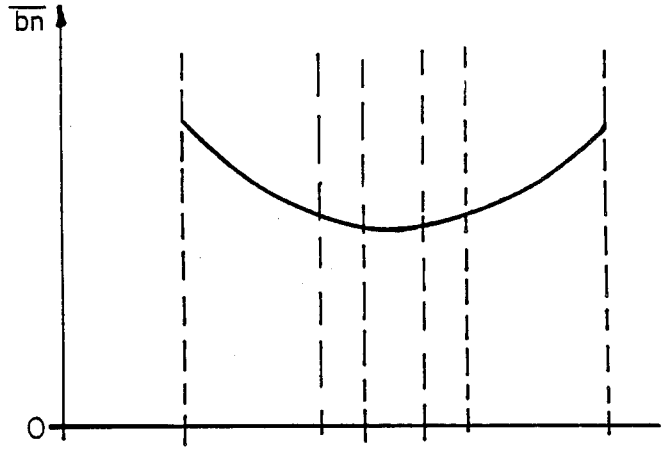
Figure 6:
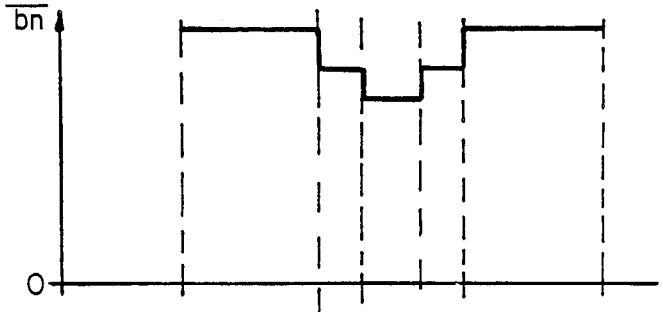
Figure 7:
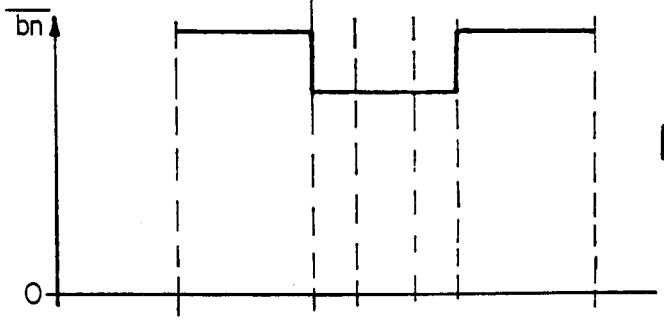

The embodiments according to FIGS. 5–7 illustrate three possibilities for the execution of the mean spacing $\bar{b}_n$.

According to FIG. 5, in an embodiment the mean edge length $b_n$ is varied from the middle of the profiling region in the direction of the ski tip and the ski end according to the curve shown in FIG. 5. The statistical distribution of the profiling elements becomes analogous to the above described manner.

The reason for the narrowing of the $\bar{b}_n$ in the push-off region A (FIG. 1) is to improve the climbing effect. By the reduction of the edge length $\bar{b}_n$ the specific pressure falling on a climbing aid element will increase, thereby the climbing effect on hard snow, especially on crusted snow, becomes increased.

A similar effect can be accomplished with the embodiments by a corresponding selection of the distribution in value of the spacing $\bar{b}_n$ according to FIGS. 6 and 7.

Another possibility for improving the climbing effect resides in the utilization of practical experience, namely, during the push-off and, climbing, the ski inner region will become loaded more than the outer region. Therefore, in a further embodiment the possibilities are present, that the variations of $\bar{b}_n$ according to FIGS. 5, 6 and 7 should be arranged only onto the inner side and, on the outer side the $\bar{b}_n$ in the climbing aiding region should not be varied.

Figure 8:
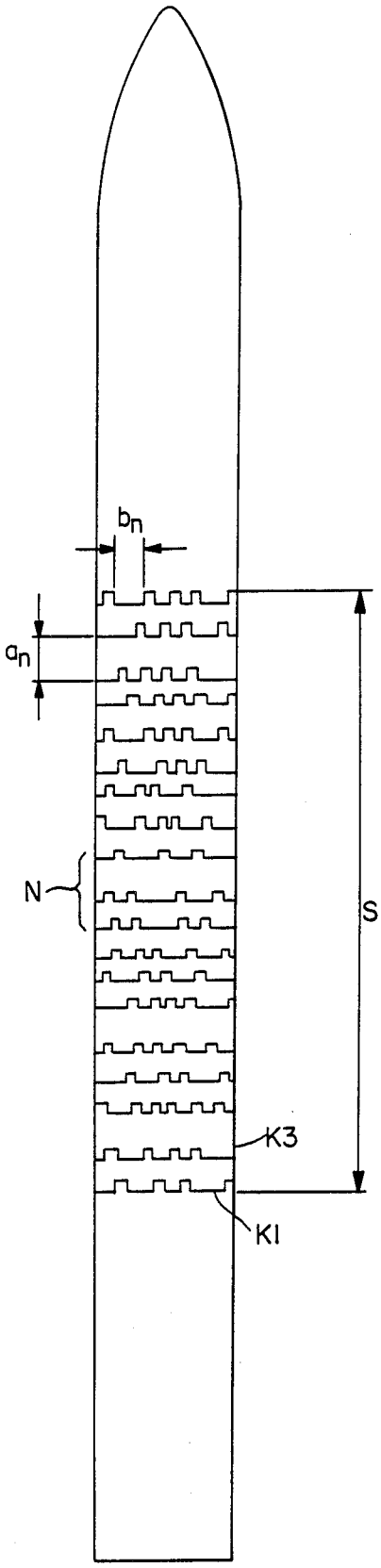
FIGS. 8 and 9 show the physical arrangement and spatial distribution of the climbing edges.
Figure 9:
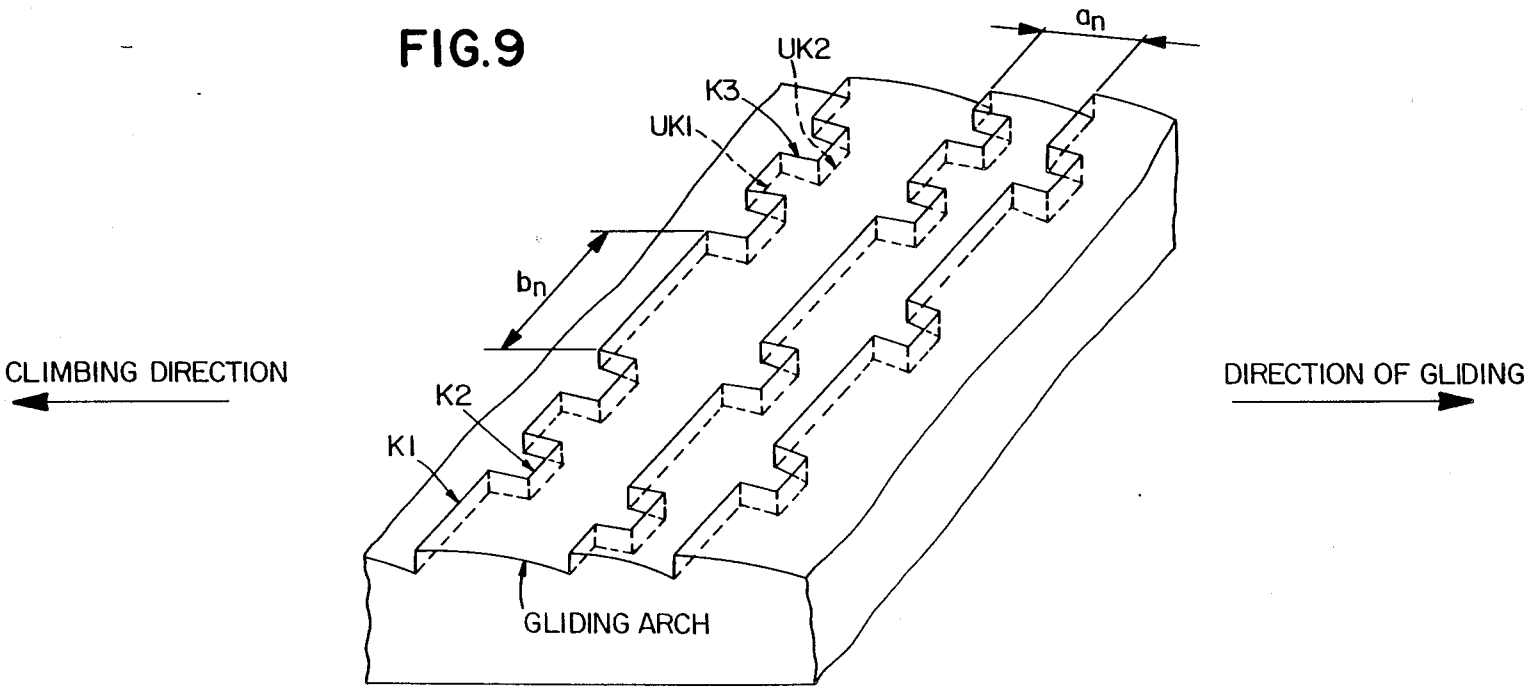

FIGS. 8 and 9 illustrate the physical appearance of the variations and the spatial structuring of the climbing and gliding aid of the present invention.

They illustrate the relative spacing and formation of the profiling region including the two-dimensional statistical distribution of the upper edges K1, K2 and K3 as well as the lower edges UK1 and UK2 and their respective positioning with the other edges.

The Figures also illustrate the individual statistical spacings $a_n$, and the median statistical spacing $b_n$ as seen in FIG. 5. FIG. 9 is a perspective view of the Section Z, cut out in FIG. 8.

We claim:

1. Running surface for a cross-country ski comprising a profiling arranged in a middle longitudinal region of the ski, said profiling comprising rows of edge profiles extending over the width of the ski and including climbing edges directed transverse, and parallel with respect to the longitudinal direction of the ski in a plane of contact of the ski with the snow, wherein said climbing edges (K1, K2) are formed on a gliding arch in longitudinally parallel spaced relationship with each other with a difference in height.

2. Running surface for a cross-country ski according to claim 1, comprising a push-off region, a mean edge length ($\bar{b}_n$) of said profiling in the push-off region (A) being smallest and increasing in a direction toward the ski tip, respectively, and ski end, and wherein in an end region of the longitudinal extent of the profiling the mean edge length ($\bar{b}_n$) is maximum.

3. Running surface for a cross-country ski according to claim 1, characterized in that the mean edge lenth ($\bar{b}_n$) is smallest on an inner edge of the ski and increases in the direction of an outer edge of the ski, wherein such increase of the mean edge length $b_n$ over the entire region of the longitudinal extent of the profiling is contintiuous.

4. Running surface for a cross-country ski as claimed in claim 2, wherein said increase of the mean edge length ($\bar{b}_n$) is continuous.

5. Running surface for a cross-country ski as claimed in claim 2, wherein said increase of the mean edge length ($\bar{b}_n$) is discontinuous.

6. Running surface for a cross-country ski as claimed in claim 3, wherein said increase of the mean edge length ($\bar{b}_n$) is continuous.

7. Running surface for a cross-country ski as claimed in claim 3, wherein said increase of the mean edge length ($\bar{b}_n$) is discontinuous.

8. In a cross-country ski, a running surface comprising a profiling arranged in a middle longitudinal region of the ski, said profiling comprising straight, and parallel edges with respect to the longitudinal direction of the ski, a climbing profile formed in a plane of contact of the ski with snow wherein said climbing edges (K1, K2) are formed on a gliding arch in longitudinally parallel spaced relationship to each other with a difference in height.

9. The combination as claimed in claim 8, wherein said mean edge length ($\bar{b}_n$) of said profiling in the push-off region (A) is the smallest and increases in a direction toward the ski tip, respectively, and ski end, and wherein in an end region of the longitudinal extent of the profiling the mean edge length ($\bar{b}_n$) is maximum.

10. The combination as claimed in claim 8, wherein said mean edge length ($\bar{b}_n$) is smallest on an inner edge of the ski and increases in the direction of an outer edge of the ski, wherein such increase of the mean edge length $\bar{b}_n$ over the entire region of the longitudinal extent of the profiling is continuous.

11. The combination as claimed in claim 9, wherein said increase of the mean edge length ($\bar{b}_n$) is continuous.

12. The combination as claimed in claim 9, wherein said increase of the mean edge length ($\bar{b}_n$) is discontinuous.

13. The combination as claimed in claim 10, wherein said increase of the mean edge length ($\bar{b}_n$) is continuous.

14. The combination as claimed in claim 10, wherein said increase of the mean edge length ($\bar{b}_n$) is discontinuous.

* * * * *